United States Patent [19]

Provence

[11] Patent Number: 4,887,832

[45] Date of Patent: Dec. 19, 1989

[54] CROSS COUNTRY SKI BINDING HAVING FLEXIBLE ARMS ADAPTED TO BE MOUNTED TO AN UPPER SURFACE

[75] Inventor: Marc Provence, Annecy-Le-Vieux, France

[73] Assignee: Salomon S.A., Annecy Cedex, France

[21] Appl. No.: 51,381

[22] Filed: May 19, 1987

[30] Foreign Application Priority Data

May 21, 1986 [FR] France ..... 86 07228

[51] Int. Cl.[4] ..... A63C 9/10

[52] U.S. Cl. ..... 280/615; 280/607; 280/609; 280/636

[58] Field of Search ..... 280/609, 607, 614, 615, 280/633, 636, 605

[56] References Cited

U.S. PATENT DOCUMENTS

| | | | |
|---|---|---|---|
| 4,083,578 | 4/1978 | Moog et al. | 280/633 |
| 4,139,214 | 2/1979 | Meyer | 280/607 |
| 4,382,611 | 5/1983 | Salomon | 280/615 |
| 4,484,762 | 11/1984 | Salomon | 280/615 |
| 4,496,169 | 1/1985 | Salomon et al. | 280/615 |
| 4,714,267 | 12/1987 | Abondance et al. | 280/615 |

FOREIGN PATENT DOCUMENTS

| | | | |
|---|---|---|---|
| 2497674 | 7/1982 | European Pat. Off. | 280/615 |
| 72766 | 2/1983 | European Pat. Off. . | |
| 0167462 | 1/1986 | European Pat. Off. | 280/615 |
| 3518400 | 12/1985 | Fed. Rep. of Germany | 280/615 |
| 2954446 | 5/1986 | Fed. Rep. of Germany . | |
| 2447731 | 8/1980 | France | 280/615 |
| 2537011 | 6/1984 | France | 280/615 |

*Primary Examiner*—David M. Mitchell

*Attorney, Agent, or Firm*—Sandler & Greenblum

[57] ABSTRACT

A binding is adapted to attach the front end of a ski boot to a ski, and is particularly useful in cross-country skiing apparatus. The apparatus includes a support which is pivotably mounted about a first transverse axis on the ski and a device for retaining the front end of the boot on the ski. The upper ski surface includes a longitudinal rib which is bordered by two longitudinal strips, and the support is adapted to be elastically biased downwardly and rearwardly by two longitudinal tongues which are elastically flexible and which are located on either side of the central rib. The front ends of the tongues are pivotably mounted to the ski around a second axis which is parallel to the first axis. This enables the structure to be formed in a relatively compact fashion with respect to the width of the ski.

23 Claims, 5 Drawing Sheets

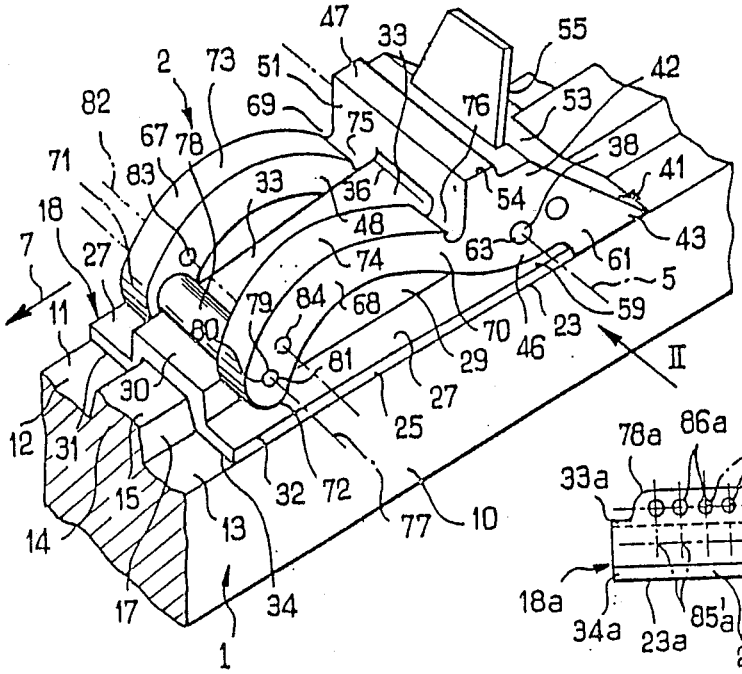
FIG_1
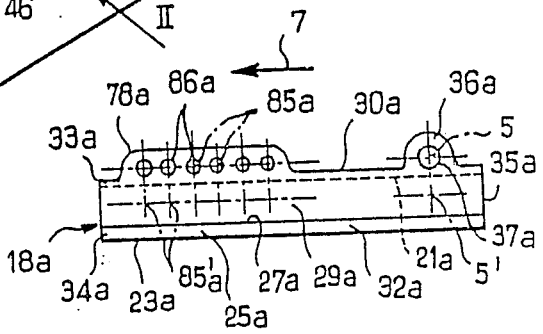
FIG_5
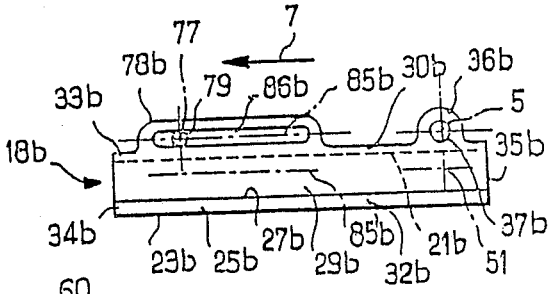
FIG_6
FIG_3
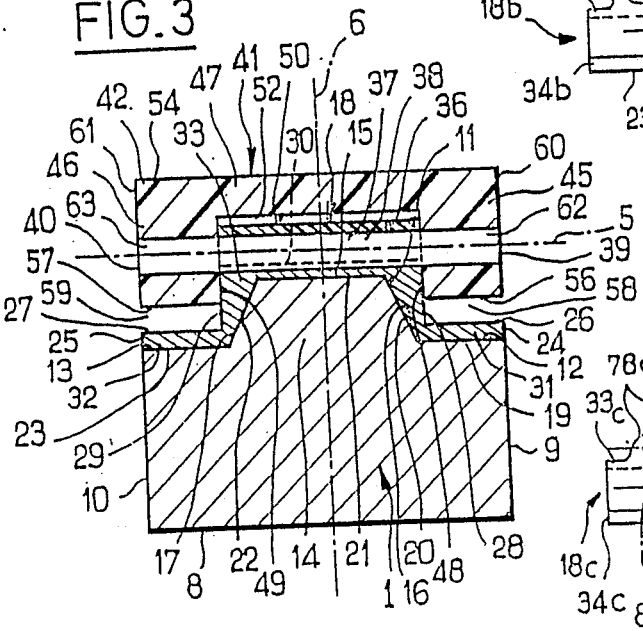
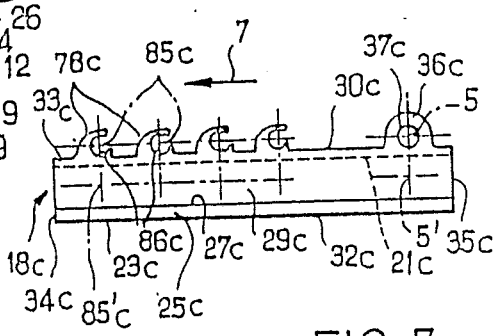
FIG_7

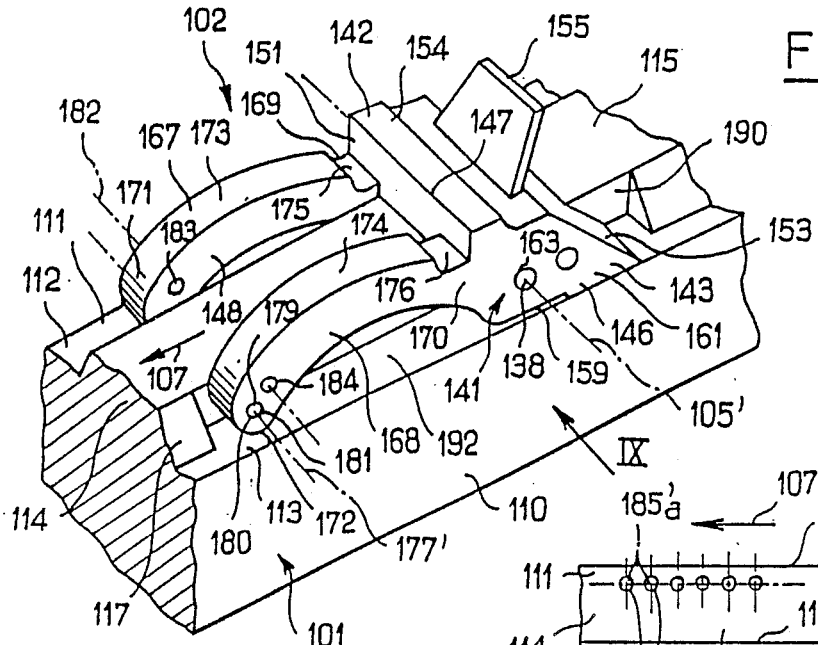
FIG_8
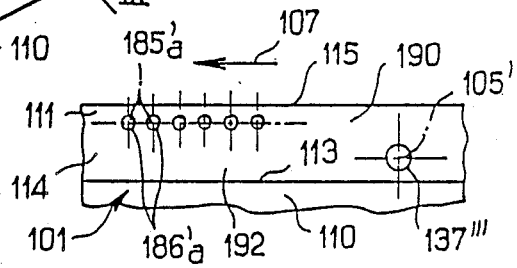
FIG_12
FIG_10
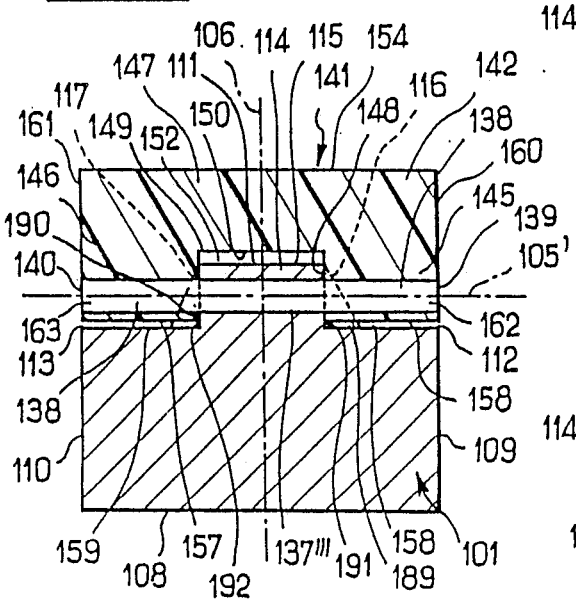
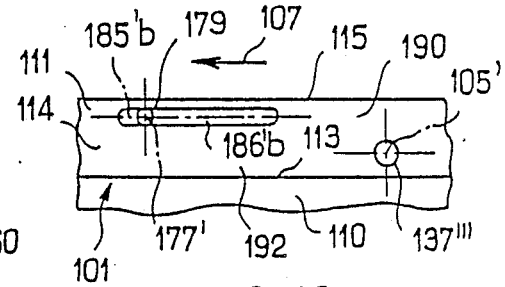
FIG_13
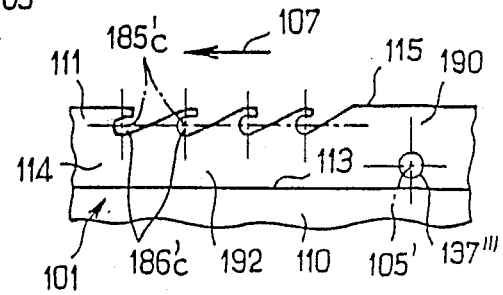
FIG_14

CROSS COUNTRY SKI BINDING HAVING FLEXIBLE ARMS ADAPTED TO BE MOUNTED TO AN UPPER SURFACE

BACKGROUND OF THE INVENTION

1. Field of the Invention

The present invention generally relates to a linkage apparatus or binding for attaching a boot to a ski, and particularly to a binding for attaching a boot to a cross-country ski. More particularly, the present invention relates to an apparatus which includes a support which is adapted to be pivotably mounted about a first axis which is transverse with respect to the longitudinal extent of the ski, which support has a rear portion with a retention apparatus for the front end of a boot. The apparatus also includes means for elastically biasing the support rotatably about the axis with respect to the ski, so that the support will move rearwardly and downwardly with respect to the ski to clamp the boot on the ski.

2. Description of Background Art and Relevant Information

Throughout the specification the terms top, bottom, front and rear are used with respect to the normal use of a cross-country ski, which is generally used in a flat position and which is supported on a generally horizontal support surface. These terms are also used with respect to the normal displacement of the ski.

Binding apparatus for cross-country skis are known, e.g., in commonly assigned French Application No. 2,447,731 (particularly with respect to its FIGS. 29 and 30) as well as in French Patent Application Serial No. 2,537,011, which is also commonly assigned (the latter French patent is specifically relevant with respect to its FIGS. 8 and 9).

Known apparatus are adapted to be mounted on a ski having a smooth longitudinal upper surface, and on which a flat base plate is screwed so as to define a transverse axis of rotation for a support with respect to the ski.

Cross-country skis are presently being developed with an upper surface having a longitudinal rib bordered by two longitudinal upper surface strips located on either side of the central rib. The strips are connected to the upper surface of the center rib by two upwardly extending generally vertical surfaces, which surfaces can be inclined if desired.

In such ribbed skis, the apparatuses described in the above two noted French patents can be mounted via a compensating element which is adapted to cover the rib and the longitudinal upper surface strips of the ski which are located on each side of the rib. The compensation element includes a smooth upper surface which is adapted to permit mounting of the base plate on a conventional ski. Similarly, the base plate can be configured along the bottom such that it will mate with the ski rib as well as the longitudinal upper surface strips which border the central rib. In both cases, it is appropriate to modify the shape and configuration of the apparatus for retaining the front end of a ski boot on the support so as to take into account the variety of possible positions of a boot on the ski.

Adapting such present apparatus is not entirely satisfactory, insofar as it causes the binding apparatus to rise with respect to the ski, particularly with respect to the longitudinal edges of the ski, thereby increasing friction of the ski against the snow as well as increasing the risks of accumulating snow in front of the apparatus. Further, such apparatus is vulnerable and susceptible to shocks, particularly along its front portion where the elastically biasing means are positioned, thereby increasing the risk of deterioration of the biasing member and the entire ski and binding.

Accordingly, one general aim of the present invention is to overcome the above-noted disadvantages by providing an apparatus for attaching the front end of a shoe or boot to a ski, and more particularly to a cross-country ski. The attachment apparatus is specifically adapted for use with a ski having an upper surface with a longitudinal rib bordered by two longitudinal upper surface strips.

SUMMARY OF THE INVENTION

The above and other objects, features and advantages of the present invention are provided for in a first aspect of the present invention by a binding apparatus which is adapted to attach the front end of a boot to a ski having an upstanding central rib and an upper surface. The binding comprises a support which is adapted to be pivotably mounted to the ski about a first axis which is transverse to the longitudinal extent of the ski. The support has a front end and a rear end, wherein the rear end of the support comprises means for retaining the front boot end on the ski when the apparatus is attached to a ski. The apparatus also includes means for elastically biasing the support to rotate about the first axis in a predetermined direction rearwardly and towards the surface of the ski. The elastic biasing means comprises a first longitudinal tongue and a second longitudinal tongue adapted to be positioned on either side of a central rib of a ski to which the binding is adapted to be attached. The two longitudinal tongues are elastically flexible, and each has a rear end attached to the support and a front end, the front end of each of the tongues being adapted to be pivotably mounted about a second transverse axis. The first and second transverse axes are mutually parallel and are spaced from each other.

The binding apparatus can be attached to a ski, and the ski has two longitudinal strips located on either side of the longitudinal rib, thereby forming a portion of the upper surface of the ski with their respective upper surfaces.

Means are also provided for adjusting the relative positions of the first and second axes with respect to each other. The adjusting means can comprise means for adjusting the position of the second transverse axis with respect to the position of the first transverse axis, or for adjusting the position of the second transverse axis with respect to the position of the tongues.

The tongues and the support can be formed from a unitary block of material, and each of the tongues has a thin portion located between a front end and a rear end of the tongue, the thinned portions thereby defining an elastic flexion zone for each tongue.

The first axis can be positioned above the longitudinal rib of the ski when the boot is attached to the ski, or can extend through an opening in the longitudinal rib when the binding is attached to the ski. The first axis can also extend through an elongated opening in the ski beneath the longitudinal rib when the binding is attached to the ski. The support can be pivotably mounted about the first axis on the ski. The second axis can be similarly located.

The apparatus further comprises at least a first intermediate mounting member which is adapted to be attached to the upper surface of the ski over the rib, the support being pivotably mounted about the first axis directly to the intermediate mounting member. The second axis can be located above the longitudinal rib when the binding is attached to the ski, or can extend through the longitudinal rib when the binding is attached to the ski, or the second axis can be located below the longitudinal rib.

The tongues have front ends which are pivotably mounted about the second axis directly on the ski. A second intermediate mounting member can be provided which is adapted to be attached to the surface of the ski, the front ends of the tongues being adapted to be pivotably mounted about the second axis to the second intermediate mounting member. The first and the second intermediate mounting members can comprise a single intermediate mounting element which is adapted to be attached to the upper ski surface.

The apparatus can further comprise a rigid pivot connecting front ends of the two tongues along the second axis, with either the ski having means for receiving the pivot or the second intermediate mounting member comprising means for receiving the pivot.

The apparatus may also comprise means for receiving the pivot in a stationary fashion to prevent radial movement of the pivot with respect to the second axis. This structure for receiving the pivot can comprise a plurality of bores along respective axes which are parallel to the first axis, which are mutually offset, and which occupy a plurality of predetermined positions with respect to the first axis, each of the bores being adapted to immobilize the pivot against relative movement thereof in a radial direction. The structure for receiving the pivot can comprises a plurality of recessed cutouts parallel to the first axis, the cutouts being mutually offset from each other along the longitudinal extent of the ski and comprising means for immobilizing the pivot by ratcheting the pivot against relative longitudinal movement.

Alternately, the means for receiving the pivot comprises a longitudinal slot parallel to the first axis, the slot comprising means for guiding the pivot in a longitudinal sliding motion and for selectively immobilizing the pivot against longitudinal sliding within the slot. The front ends of each of the tongues comprise a plurality of bores provided along the second axis which are substantially coaxial with corresponding bores on the other tongue, and which are adapted to receive and immobilize the pivot against radial motion.

In another aspect, the present invention provides a binding which is adapted to be positioned on a ski having a longitudinally extending upper surface. The binding comprises a support member which includes means for retaining the front end of a ski boot on the ski when the binding is attached to the ski and the boot is positioned on the ski, and two substantially flexible elastic arms, each arm having a front end and a rear end and being attached at their respective rear ends to a support, the front arm ends including means for attaching the arms to the ski when the binding is positioned on the ski.

The means for attaching the front ends of the arms to the ski can comprise means for pivotably and directly attaching the front arm ends to the ski, or via the intermediate mounting member adapted to be positioned between the support and the arms, on one hand, and the upper surface of the ski, on the other hand. The mounting member includes a generally cylindrical bore which is adapted to receive at least one pivot pin around which the front ends of the arms are adapted to be pivoted. The pivot pin is adapted to be inserted into the bore in the mounting member for pivoting the front ends of the arms about a second axis parallel to a first axis about which the support is adapted to be pivoted. The front ends of the arms are adapted to be pivoted to the upper ski surface at a point which extends above the uppermost surface of the ski when the binding is attached to the ski. The ski can include a longitudinal rib, and the front ends of the arms are adapted to be pivotably attached to the ski. Each of the arms can include an aperture which is adapted to be aligned with a pivot pin receiving aperture on the binding or on the intermediate element. The spaced apertures can be located on the front end of each of the arms, the apertures comprising means for adjustably positioning the front ends of the arms with respect to the ski.

The apparatus can further comprise means for selectively and adjustably positioning the front end of the arms to the ski; the selective positioning means can comprise a plurality of apertures attached to the intermediate mounting member adjacent a front end of the mounting member. Alternately, the adjusting means can comprise an elongated slot adapted to receive a pivot pin which is inserted through an aperture in a front end of one of the arms. Further, the apparatus can include a plurality of substantially circular recesses spaced along the longitudinal extent of the ski and extending upwardly from the mounting element, the recesses comprising a plurality of ratchet recesses which are adapted to receive the pin.

The apparatus can also comprise an intermediate mounting member, the apparatus being adapted to be attached to a ski having a central longitudinal rib and upper surface strips, the apparatus further comprising a mounting element having a complementary configuration which is adapted to fit over the rib and rest upon the upper surface of the ski. The intermediate mounting member includes a bore and is adapted to receive a pin for pivotably mounting the support to the intermediate mounting member. This intermediate mounting member includes two spaced bores, and the rib includes a generally transversely extending bore, wherein all three of the bores are adapted to be aligned when the binding is attached to the ski and a pivot pin is inserted into all of the aligned bores to establish the first axis about which the support member is pivotably mounted.

The mounting member includes an upwardly extending projection which includes a bore which comprises means for receiving a pivot pin about which the support member is adapted to be pivoted. The apparatus further comprises means for pivotably attaching the support to the ski.

Means can also be provided for attaching the support to the ski which comprise a plurality of apertures adapted to be aligned with an aperture in the ski for receiving a first pivot pin. Means can be provided for attaching the support to the ski which include at least one aperture in the support adapted to be aligned with at least two bores in the mounting element and with one bore in a longitudinal rib of the ski. The means for attaching the front arm ends to the ski comprise means for pivotably attaching the front arm ends to the ski, and the support is also pivotably mounted to the ski. The apparatus can further comprise an intermediate mounting member adapted to be positioned between the support and the arms, on one hand, and the upper surface of the ski. The arms and support can be adapted to be mounted to the ski above an upper surface of a central ski rib, or the arms and the support can be adapted to be attached to the ski by pivot pins extending through an intermediate mounting member and a central ski rib. Alternately, the arms and support can be attached to the ski below the rib.

The front arm ends are adapted to be selectively pivotably attached to the ski at a plurality of positions along the longitudinal extent of said ski; or can be selectively positioned on the intermediate mounting member.

A plurality of spaced apertures are provided on the intermediate member, or directly on the ski, each aperture comprising means for adjustably receiving a pivot pin to establish said second axis.

The selective positioning means comprises, e.g., an elongated slot adjacent a front end of said mounting member, or on the front of the ski, said slot being parallel to the longitudinal extent of said ski. The slot is adapted to receive a pin inserted through an aperture in a front end of each of the arms. Alternately, a plurality of substantially circular recesses are spaced along the longitudinal extent of the ski or extend upwardly from the mounting member, the recesses comprising a plurality of ratchet recesses which are adapted to receive the pin. The mounting member can include one or more upwardly extending projections which include bores which comprise means for receiving pivot pins about which the support member and the arms are adapted to be pivoted.

BRIEF DESCRIPTION

The above and other objects, features and advantages of the present invention will be more fully described with respect to the accompanying drawings, in which like reference numerals represent similar parts throughout the several views, the drawings illustrating a plurality of nonlimiting embodiments of apparatus formed in accordance with the present invention, in which:

FIG. 1 is a perspective view of a first embodiment of the present invention, shown as being mounted on a ski, with a simplified showing of an apparatus for retaining the front end of a boot on a support; the retention apparatus is itself known per se, e.g., as shown and described in French Patent Application No. 2,447,731 commonly assigned hereto, the disclosure of which is expressly incorporated by reference herein, and which is embodied in U.S. Pat. Nos. 4,484,762 and 4,382,611; the apparatus of the present invention is illustrated as being in a limit position in which the support has moved over a maximum distance towards the rear and bottom of the ski;

Figure 2:
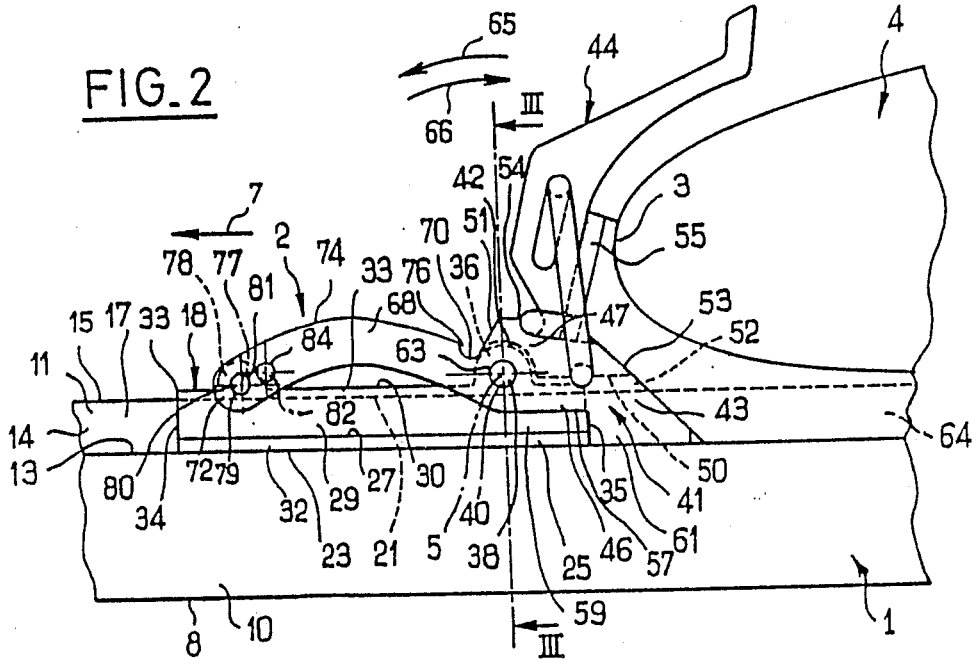
FIG. 2 is a side plan view of the apparatus of FIG. 1 in lateral elevation, showing the complete retention apparatus.
Figure 4:
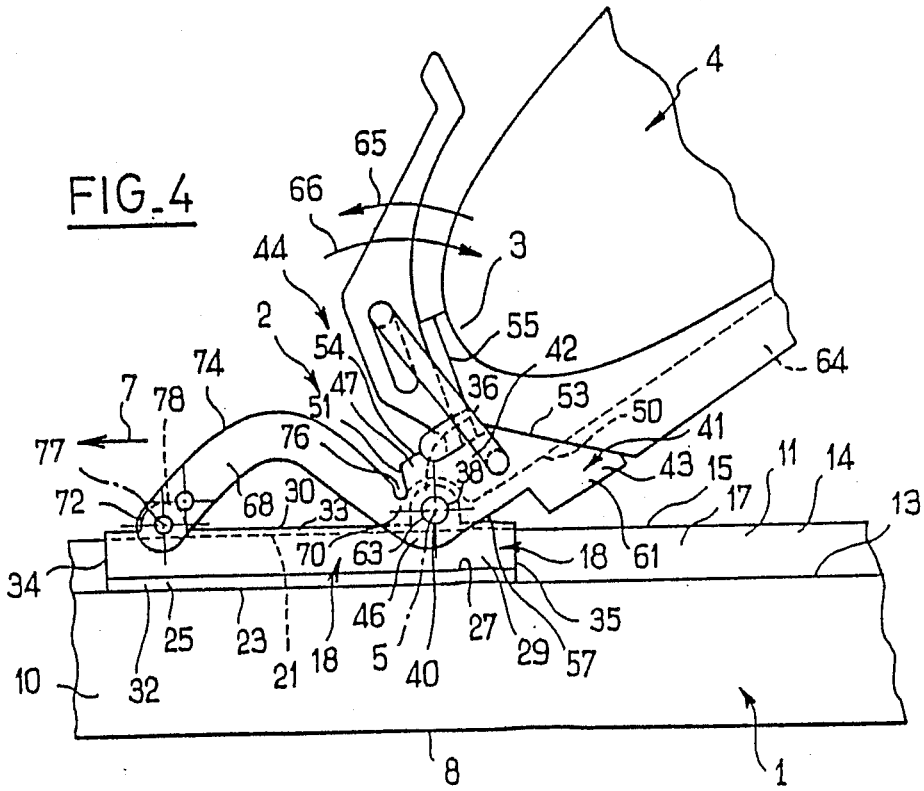
Figure 2A:
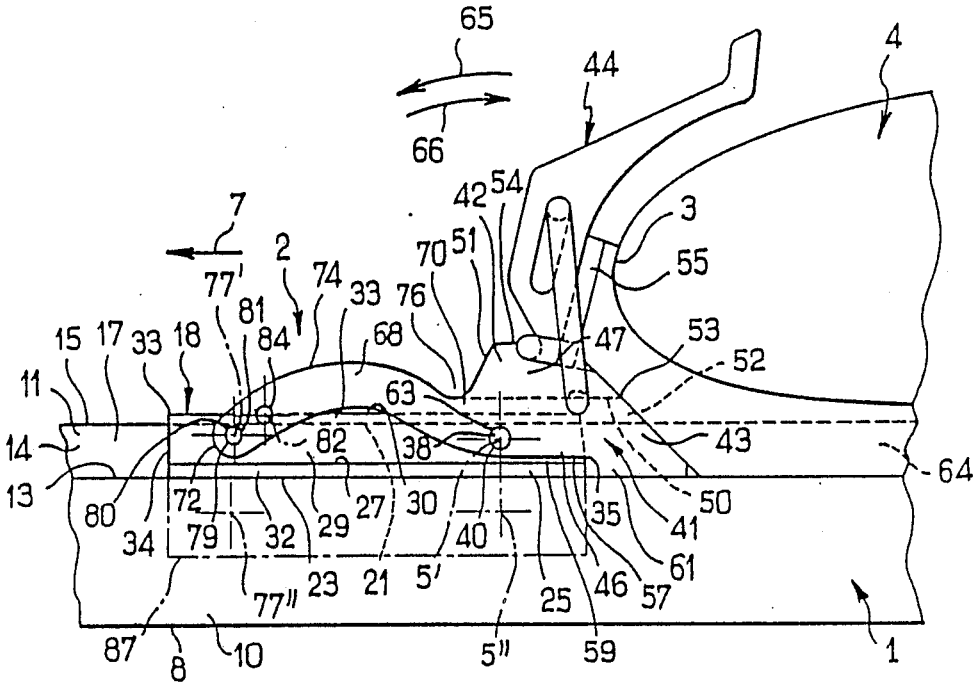
Figure 3A:
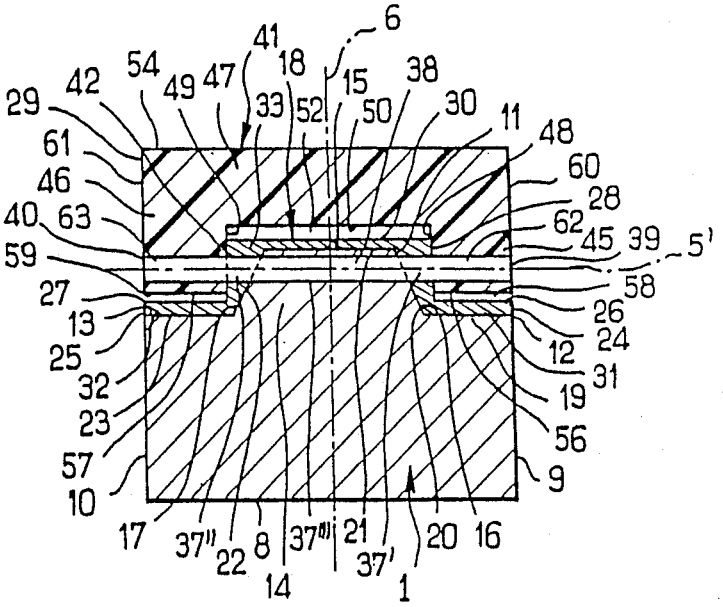
FIG. 3 is a cross-sectional view of the apparatus taken along line III—III of FIG. 2.
Figure 9:
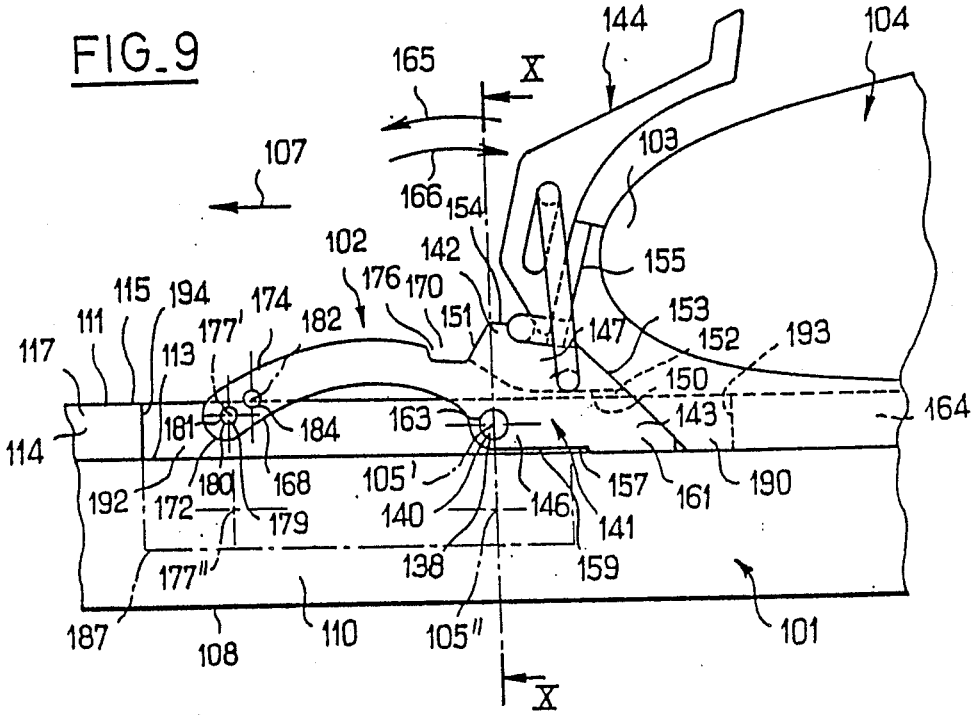
Figure 11:
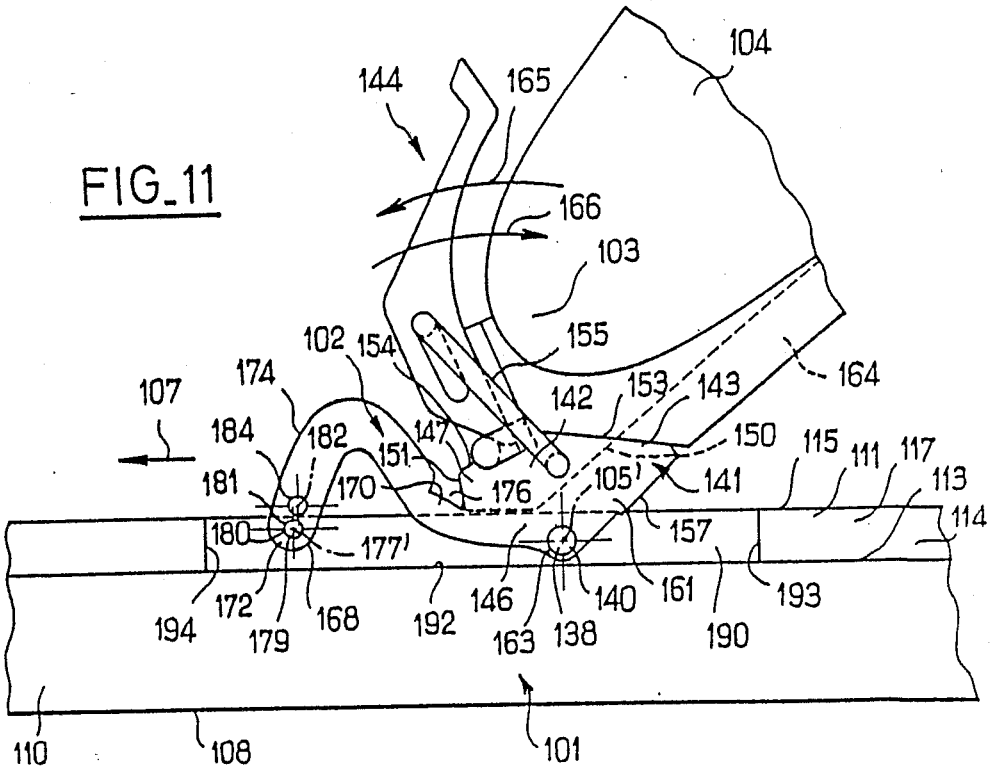

FIGS. 2*a* and 3*a*, respectively, are plan views representing an alternative embodiment of the invention; these views are similar to the views shown in FIGS. 2 and 3, respectively;

FIG. 4 is a view of the apparatus of FIG. 1 in lateral elevation, after the support has pivoted upwardly towards the front and top of the ski;

FIGS. 5–7 illustrate three separate embodiments of an intermediate mounting element which is used to pivotably mount the support and tongues which are attached to the support;

FIGS. 8–14 are views corresponding to the views of FIGS. 1–7, and illustrate another embodiment of the present invention which provides for pivotable mounting of a support and of tongues directly on the ski, wherein;

FIG. 9 is an elevational view of the embodiment of the apparatus formed in accordance with FIG. 8, shown along the line IX—IX in FIG. 8;

FIG. 10 is a cross-sectional view taken along transverse plane X—X illustrated in FIG. 9;

FIG. 11 is a view of the apparatus of FIG. 8 in lateral elevation, after the support has pivoted upwardly towards the front and top of the ski; and FIG. 12–14 represent partial views of three additional examples of structure which are adapted to modify the ski ribs so that the front ends of tongues can be pivotably mounted on the ribs.

DESCRIPTION OF PREFERRED EMBODIMENTS

Referring more specifically to the present invention, the present binding apparatus includes a support and elastic biasing means for biasing the support about a first axis transverse to the ski. The elastic biasing means for the support comprise two longitudinal, elastically flexible tongues which are respectively positioned on opposite sides of a central rib of a cross country ski. Each of the tongues includes a rear end which is attached to a support and a front end which is adapted to be pivotably mounted about a second transverse axis on the ski. The first and second axes of the tongues are mutually parallel and occupy predetermined positions with respect to each other.

Such structure makes it possible to reduce obstructions of the elastic biasing means by using the space which exists as a result of the difference in height between the upper surface of the longitudinal rib of the ski and the two upper surfaces of the strips which border either side of the central rib. The elastic biasing means thus become less susceptible to shocks; and the presence of these strips in the immediate vicinity of the edges of the ski results in raising the lower ski edges by an amount which is less than the edges would have been raised if the elastic biasing means were located at a level above the rib. As a result, less snow is taken up by the ski. In other words, the lower edges of the skis move upwardly during skiing by an amount which is less than they would move if the elastic biasing means were positioned above the central ski rib.

The first and second transverse axes about which the support and the tongues, respectively, are adapted to pivot, are in one embodiment positioned above the longitudinal central rib of the upper surface of the ski. Further, it is possible to improve the advantage which results from reducing obstruction of the front boot end binding assembly with the ski, and particularly with respect to the edges of the ski, by positioning the first and second axes such that they cut through the ski either at the level of the longitudinal rib of the ski, or below it. Thus, it should be understood that one of the axes can be located in one position along the height of the ski while a second axis is located in another of such positions.

The support can be pivotably mounted about a first axis which is on the ski itself, or the first axis can be positioned on a first intermediate mounting member which is adapted to be attached to the upper surface of the ski and which straddles the central ski rib. In the latter case, the support will be pivotably mounted about a first axis which is located on the intermediate mounting means. Whichever method of mounting of the support is used, the front ends of the tongues can themselves be pivotably mounted about the second axis directly on the ski, or on a second intermediate mounting member which is itself adapted to be attached to the upper surface of the ski so that it straddles the rib of the ski. When such intermediate mounting members are adapted both for use with the support and with the front ends of the tongues, the first and second mounting members preferably comprise a single mounting element which is adapted to be attached to the upper surface of the ski and which straddles the ski rib.

According to one preferred embodiment of the present invention, means are provided for adjusting the relative position of the first and second axes, e.g., by adjusting the position of the second axis with respect to the first axis. Similarly, means can be preferably provided for adjusting the position of the second transverse axis with respect to the tongues attached to the support means. These adjusting means can be simply configured in order to adjust the elastic bias of the support in a predetermined direction; further and likewise, the resistance of the support, which elastically opposes the force exerted by the elastic biasing means, can serve to rotate the support in a direction opposite to the predetermined direction.

Accordingly, an apparatus according to the present invention comprises, in a preferred embodiment, a rigid pivot which connects the front ends of the tongues along the second axis; in one case the pivot is attached directly to the ski, and in a second case, to the intermediate mounting means. The ski and mounting element thereby include means for receiving the pivot along a second axis between the front ends of the tongues. These receiving means can comprise, e.g., a first plurality of openings which are provided along respective axes which are parallel to the first axis, mutually offset from each other and which occupy respective predetermined positions with respect to the first axis. Each of the openings is adapted to immobilize the pivot against relative movement along any radial direction with respect to the axis of the opening. This makes it possible to selectively make the second axis coincide with the axis of ay one of the openings. Alternately, the reception means can comprise a plurality of cutouts, in the overall form of a ratchet, which are provided along respective axes which are parallel to the first axis. These cutouts will be mutually offset from and will occupy respective predetermined positions with respect to the first axis. Each cutout will be adapted to immobilize the pivot, in a ratchet fashion, against relative movement along any radial direction with respect to the axis of the cut out. This again makes it possible to form the second axis so as to coincide with the axis of any one of the cut outs. In yet another alternate embodiment, a longitudinal slot can be provided along a direction which is substantially perpendicular to the first axis, wherein the slot is adapted to guide the pivot in a longitudinally sliding fashion. Means are also provided for immobilizing, virtually at will, the pivot against longitudinal sliding within the slot, in any position which corresponds to a desired position of the second axis with respect to the first axis.

When a pivot is thereby provided to connect the front ends of the tongues, the front ends can preferably comprise, e.g., a plurality of respective openings which are provided along axes which are common to openings of the two tongues which are parallel to the first transverse axis. Any two coaxial openings which are adapted to receive the pivot and to immobilize the pivot against relative movement along any radial direction with respect to the common axis of the two openings can be used.

It should also be noted that the possibility of adjusting the apparatus does not require a substantial increase in the complexity of the apparatus, either with respect to structure, manufacture, and/or use.

In fact, the simplicity of the structure and of manufacturing the apparatus, in accordance with the present invention, increases when in accordance with a particularly preferred embodiment, the tongues comprise a single or integrally formed piece of elastically flexible material which are integrally.. formed with the support. In this case, it is preferable to provide between the front and rear ends of each tongue, a localized thinned portion which defines a preferred elastic flexion zone for the tongues. Accordingly, the front end of each tongue can be eliminated from serving any purpose with respect to the elastic flexibility of the tongue, and can be dimensioned in a fashion so as to be provided with a rigidity such that it will not deform when the tongue flexes. Such stability, which results from the shape of the tongue along the zone in which it is pivotably mounted about the second axis with respect to the ski, i.e., in which it transmits to the pivot forces which result from possible elastic flexion thereof, considerably increase the life of the tongue. Thus, the use of a thinned intermediate tongue zone increases the useful life of the tongue.

With more specific reference to the embodiments of FIGS. 1–4, a cross-country ski 1 is disclosed having at least a longitudinal median zone; this zone is illustrated and is adapted to support a binding apparatus 2 in accordance with the present invention, which binding is adapted to ensure attachment of the front end 3 of boot 4 to ski 1. The binding provides for relative pivotable motion of the support about axis 5, which is attached with respect to ski 1 as illustrated in FIG. 2, shown with respect to boot 4, and which is positioned transversely to longitudinal median plane 6 of ski 1. In the following discussion it has been assumed that plane 6 will be vertical, as viewed along the direction which is detailed hereinafter. Axis 5 is positioned horizontally, and the ski 1 is itself horizontal and placed in a normal utilizable position. Specifically, it has been assumed that the longitudinal direction 7, which comprises the normal direction of displacement of the ski, is substantially horizontal. Of course, any references relating to the orientation and height of the elements as described in detail in the description which follows hereinafter are merely intended to be indications of relative positioning, without implying any limitations with respect to the condition of use of the apparatus in accordance with the present invention. The other embodiments of the present invention should be similarly interpreted, and have therefore been described with respect to the normal position of the ski in use, which we have assumed to be horizontal.

Ski 1 is illustrated as being of the type known as an "edged" ski, comprising along its longitudinal median zone a longitudinal (sole) lower surface 8 which is generally planar and horizontal, and which is perpendicular to plane 6. The two edge surfaces 9 and 10 (FIG. 3) which extend longitudinally over the ski are generally planar and are positioned symmetrically with respect to plane 6. These edge surfaces can be, e.g., parallel, and an upper ski surface 11 is provided which can be longitudinal and which is connected to sole 8 by side surfaces 9 and 10. In a typical fashion, upper surface 11 of ski 1 includes, at its junction point with the surface of side 9 and the surface of side 10, two longitudinal strips 12 and 13 which are symmetrical with respect to each other about plane 6, and which are spaced downwardly from the upper surface of the central longitudinal rib. Strips 12 and 13 are both planar and coplanar to each other, as well as approximately parallel to the surface of sole 8, i.e., approximately horizontal, on either side of the longitudinal median zone of the ski. The upper surfaces of the two strips 12 and 13 also border and define the central longitudinal rib 14 of ski 1, which rib is preferably positioned symmetrically with respect to plane 6 and which is shaped, along a transverse cross-section of the ski, i.e., or perpendicular to direction 7, as an isosceles trapezoid.

The cross-sectional area as defined by upper rib surface 15, which surface extends longitudinally, is offset upwardly with respect to strips 12 and 13 and is generally parallel to the upper strip surfaces as taken along the longitudinal median zone of the ski. The cross-section is also defined by two side surfaces 16 and 17 which respectively connect surface 15 to strips 12 and 13, with surfaces 16 and 17 being generally planar along the longitudinal median zone of the ski. The strips are positioned symmetrically on opposite sides of plane 6, and the opposite sides of the rib extend in a converging fashion from the base of the ski upwardly towards the top surface of the ski. Such a configuration of the upper surface 11 of ski 1 comprises only one (non-limiting) example of the present invention; specifically, rib 14 could be asymmetrical with respect to plane 6, and/or strips 12 and 13 could be mutually asymmetrical with respect to the central median plane. Alternately, rib 14 could have a cross-section which is different from that of an isosceles trapezoid, e.g., it could comprise a triangular cross-section, in which case upper surface 15 would be reduced to an edge which would join side surfaces 1 and 17. One of ordinary skill in the art should be able to adapt, without difficulty, and without going beyond the scope of the present invention, a binding apparatus 2 as a function of the variety of possibilities of shapes which upper surface 11 of ski may take. This will result from the complementary shapes of the binding and the upper ski surface.

In the specific embodiment illustrated in FIGS. 1–4, assembly 2 includes an intermediate mounting element 18 which is adapted to be attached to the upper surface 11 of the ski and which has a shape which is substantially complementary to the shape of upper ski surface 11, in order to best mate therewith. In other words, the intermediate mounting element straddles both sides of central ski rib 14 and covers, along both sides of the rib, the two longitudinal, substantially horizontal strips 12 and 13 along the longitudinal central zone of the ski. The intermediate mounting element can be attached to upper ski surface 11 by any appropriate means, known to those of ordinary skill in the art, e.g., by screwing or gluing the mounting element to a portion of the upper ski surface at individual attachment locations, or by distributing the attachment zones over as large a surface area as is possible.

More specifically, element 18 is generally omega shaped, as seen from the cross section defined by its longitudinal surfaces (see FIG. 3). Specifically, as seen in FIG. 3, mounting member 18 includes a first generally planar lower surface 19, a second upper inclined surface 20, a third top substantially planar surface 21, a fourth inclined surface 22, and a fifth substantially planar surface 23. These surfaces are complementary shaped with respect to upper ski surface strip 12, side rib surface 16, upper surface 15, side rib surface 17 of rib 14, and the upper surface of strip 13, all as taken along the longitudinal median zone of the ski. The opposed side edges 24 and 25 of the intermediate mounting element are generally planar and are symmetrical to each other with respect to plane 6. These surfaces are mutually parallel, e.g., in the embodiment illustrated in FIGS. 1–4, they extend in a substantially coplanar and continuous fashion upwardly from edge surfaces 9 and 10 of the ski and are connected, respectively, to surfaces 19 and 23 of element 18. Five upper planar surfaces including, i.e., surfaces 26 and 27, are adjacent to edge surfaces 24 and 25, are directed upwardly, and are positioned substantially perpendicularly to plane 6 as well as parallel to movement direction 7. Surfaces 28 and 29 are symmetrical to each other With respect to plane 6 and are substantially parallel to the plane; these surfaces are positioned on the outside of the intermediate element, and an upper surface 30 is substantially parallel to surfaces 26 and 27 and is offset upwardly with respect to these surfaces. Surface 30 is connected to surfaces 26 and 27 by substantially vertical surfaces 28 and 29. Surfaces 26 and 27 define, respectively, with respect to surfaces 19 and 23, two zones 31 and 32 for covering longitudinal strips 12 and 13 of upper ski surface 11 with intermediate element 18. Surfaces 28, 30 and 29, respectively, define, together with surfaces 20, 21 and 22, a zone 33 which straddles rib 14 with element 18.

Towards the front and rear of element 18, perpendicularly with respect to direction 7, two transverse planar edge surfaces 34 and 35 are provided at opposite ends of the mounting element. All of the various longitudinal surfaces, as discussed previously with respect to mounting element 18, are located between these two end surfaces.

In a zone of the mounting element which is closer to transverse rear surface 35 than to transverse front surface 34, upper surface 30 of mounting element 18 includes an upwardly extending localized protuberance or projection 36 (see FIG. 3) which is spaced, along a direction defined along plane 6, by coplanar localized extensions of surfaces 28 and 29, respectively. Projection 36 is situated above upper rib surface 15 along first axis 5, and is adapted to be bored along both sides of the longitudinal surface, i.e., from surface 28 to surface 29 in a fashion which is substantially perpendicular to plane 6 so as to form a substantially cylindrical bore 37 about axis 5 having a diameter such that bore 37 is not secant with surface 21 of intermediate mounting element 18. To this end, the diameter of bore 37 of projection 36 will be less than twice the distance separating axis 5 from surface 21 along a direction perpendicular to the surface.

In the alternative embodiment illustrated in FIGS. 2*a* and 3*a*, respectively, the transverse journal axis of zone 3 at the front end of boot 4 on ski 1 cuts the ski at the level of rib 14, with the position of second axis 5′ being illustrated best in FIGS. 2*a* and 3*a*. In other words, in this embodiment the axis is located within the rib, whereas in the embodiment in FIGS. 1–4 the axis is located above the rib and is located in a projecting portion (only) of the mounting element. In this alternative case, surface 30 could be provided without a protuberance 36, and bore 37 will be replaced by two bores 37′ and 37″, respectively, which comprise cylinders of revolution located about axis 5′, respectively, between surfaces 28 and 20 and between surfaces 22 and 29. These cylinders of revolution will have identical diameters such that the bores will be integrally positioned between surface 21 and surfaces 26 and 27, respectively. More specifically, the diameters of these cylinders will be less than the distance separating surface 21 from surfaces 26 and 27, as viewed perpendicularly with respect to surface 21, and will be less than twice the size of the smaller of the distances separating axis 5′ from surface 21, in a direction perpendicular to the surface, and axis 5′ from surfaces 26 and 27, also in a direction perpendicular to the surfaces. Bores 37′ and 37″ on the mounting element extend, in a substantially coaxial fashion with respect to rib 14, this rib includes a cylindrical bore 37‴ having an identical diameter to that of bores 37′ and 37″, i.e., and which is positioned in a non-secant fashion with respect to upper rib surface 15.

Depending upon the particular embodiment of the invention involved, bore 37 of the assembly formed by coaxial bores 37′, 37″ and 37‴, respectively, is adapted to receive a coaxial pivot 38 which is generally shaped in the form of a cylinder of revolution about either axis 5 or 5′ and which has a diameter which is substantially identical to the diameter of bore 37 or to the diameter of each of bores 37′, 37″ and 37‴, respectively. It should be understood that it is possible to immobilize pivot 38 against rotation about axis 5 or 5′, and/or to prevent it from translating in a direction parallel to either of the axis by appropriate (and conventional) structure positioned in any of the bores or bore sections. Alternately, it is possible to permit pivot 38 to freely slide or pivot in the bore(s), as discussed hereinafter.

Pivot 38 has a length along axis 5, 5′ perpendicular to plane 6 which is greater than the distance which separate surfaces 28 and 29 of intermediate mounting element 18, such that when the pivot is positioned in a symmetrical fashion with respect to plane 6, pivot 38 also forms a projection outwardly with respect to surfaces 28 and 29, respectively, above surface 26 and surface 27. As one example, pivot 38 is defined by planar end surfaces 39 and 40, perpendicular to axis 5 or 5′, and the distance separating surfaces 39 and 40 along this axis (FIG. 3) is substantially equal to the distance which separates surfaces 24 and 25, such that surfaces 39 and 40 are respectively coplanar with surfaces 24 and 25 when pivot 38 is positioned symmetrically with respect to plane 6.

Pivot 38 rotatably guides rigid zone 42 of support 41 about axis 5 or 5′; and zone 42 cannot be otherwise displaced with respect to mounting element 18. Support zone 43 is rigidly attached to zone 42 on support 41 and includes a retention apparatus 44 for retaining the front end 3 of a ski boot 4. This apparatus can be of any known configuration, is adapted to attach the front end 3 of a boot 4 to support zone 43, and is suitably adapted to free boot 4 with respect to support 41. By way of non-limiting example, one such retention apparatus 44 is described in French Patent Application Serial Nos. 2,447,731 and 2,537,011 (U.S. Pat. Nos. 4,484,762 and 4,382,611 respectively, to which reference has already been made throughout the application, the teachings of which are expressly incorporated by reference herein.

Zones 42 and 43 are preferably integrally formed from one unitary piece of the same material, and have a shape which is adapted to straddle mounting element 18 over surfaces 28, 29 and 30, as well as over any localized protuberance 36 if necessary. The zones will straddle the rib of the ski from a point forwardly of the plumb of axis 5 or 5′, and will extend to the location of rear transverse surface 35. Preferably, and with more specificity, zone 43 will be positioned over rib 14 along surfaces 15, 16 and 17 located at the rear of rear transverse surface 35 of element 18.

Support zones 42 and 43, as will become clear from FIG. 3 with respect to zone 42, will be configured in the shape of an inverted U, as viewed in cross-section via a plane which is perpendicular to direction 7.

More precisely, when considered in their overall configuration, zones 42 and 43 include wings 45 and 46 which are positioned, respectively, along both sides of element 18, i.e., respectively facing surfaces 26 and 28 of element 18 and surfaces 27 and 29 of the mounting element. Wings 45 and 46 are connected to each other, above upper surface 30 of mounting element 18, as well as above any localized projection or protuberance 36 of surface 30, by a core plate 47. Wings 46 have surfaces which face surfaces 28 and 29 of element 18, and planar surfaces 48 and 49 are mutually parallel and symmetric to each other with respect to plane 6 and are mutually spaced from each other in a perpendicular fashion by a distance which is substantially equal to the distance which separates mounting element surfaces 28 and 29, with which surfaces 48 and 49 are in contact, respectively. In this fashion, the possibility exists that these surfaces will contact each other and create the possibility of relative sliding between the surfaces. Surfaces 48 and 49 therefore extend upwardly until they connect with a lower surface 50 of core 47, which surface is positioned so that it will face projection 36 as well as surface 30 of mounting element 18 at the rear of projection 36; and so that it will face upper surface 15 of rib 14 along the rear transverse surface 35 of mounting element 18. In this fashion, a continuous clearance 52 is provided with respect to support 41, as illustrated in either of FIGS. 2 or 2*a*, between a portion of the upper surface of element 18 and a lower surface (central) of support 41.

Surface 50, located forwardly of the plumb of either axis 5 or 5′, and above projection 36, is an interrupted surface portion of the support and is adapted to be connected to a front transverse surface 51 of core 47. The interrupted portion is substantially planar, is perpendicularly oriented with respect to plane 6, and rises rearwardly, as viewed with respect to the drawings in FIGS. 2 and 2*a*.

At its rear point, surface 50 is connected, as are surfaces 48 and 49, to a planar surface 53 which is perpendicular to plane 6 and which rises forwardly in the position illustrated in either of FIGS. 2 or 2*a*. This planar surface 53 comprises a zone 3 for retaining the front end of a boot 4, and an abutment surface along the front and bottom of the surface, as is clear from French Patent Application Serial Nos. 2,447,731 and 2,537,011, which have been previously incorporated by reference in this application. Towards the top and front of member 41, abutment surface 53 is connected to surface 51 by upper surface 54 of core 47. A support element 55 is attached to surface 54 in a stationary fashion, and projects upwardly and rearwardly as viewed in FIG. 2. Element 55 is positioned on the rear of surface 54 and the top of zone 3 of the front and top end of boot 4, as described in the two aforementioned French patent applications. Support element 55 and abutment surface 53 form an integral portion of retention apparatus 44, and are therefore not further detailed herein.

Along the bottom, surfaces 48 and 49 are connected to respective lower surfaces 56 and 57 of wings 45 and 46; surfaces 56 and 57 are substantially perpendicular with respect to plane 6 and are symmetrical to one another on either side of the plane. Along zone 42, surfaces 56 and 57 are planar and coplanar, and are positioned parallel to surfaces 26 and 27 of intermediate mounting element 18, respectively. In this fashion, clearances 58 and 59 are provided, with reference to the positions illustrated in either of FIGS. 2 or 2*a*, between surfaces 26 and 56, and 27 and 57, respectively.

At the level of rear surface 35 of mounting element 18, surfaces 56 and 57 (see FIGS. 2 and 2*a*) are adapted to flex downwardly, in a direction substantially perpendicular to direction 7, so as to comprise rear planar zones which are pressed flat against strips 12 and 13, respectively, of the upper ski surface 11. At their rear portions, rear zones of surfaces 56 and 57 are connected to abutment surface 53 along the length of a cut edge of the surface.

Wings 45 and 46 of support 41 are positioned on opposite sides of plane 6 and are defined by respective planar surfaces 60 and 61 which are mutually parallel to each other, as best illustrated in FIG. 3. The surfaces 60 and 61 are symmetric with respect to each other about plane 6, and are preferably positioned in coplanar relationship with surfaces 9 and 24, and 10 and 25, respectively. Surface 60 thus connects surfaces 56, 53, 54 and 51 while surface 61 connects surfaces 57, 53, 54 and 51.

The height or level of surfaces 56 and 57, particularly when support 41 occupies the position illustrated in either of FIGS. 2 or 2*a*, is intermediate between the lower level of opening 37 (or openings 37', 37'' and 37'''), i.e., the lower level of pivot 38 along its respective projecting zones located along both sides of mounting element 18, and the level of surfaces 26 and 27 of zones 31 and 32 which cover strips 12 and 13 of upper surface 11. In this fashion, axes 5 and 5' cut wings 45 and 46, which wings are bored along both sides of the axis, respectively, between surfaces 48 and 60 and between surfaces 49 and 61. Respective openings 62 and 63 are provided for receiving pivot pin 38.

Each of the openings 62 and 63 is a cylinder of revolution taken about the periphery of axis 5 or 5' having a diameter which is substantially identical to the diameter of pivot 38 so as to provide structure for guiding support 41 in a rotatable fashion about axis 5 or 5' with respect to mounting element 18, all without the possibility of other relative movement. If pivot 38 is to be freely rotatable within either opening 37 or openings 37', 37'' or 37''', it can be attached in any fashion to support 41 in openings 62 and 63. If, to the contrary, pivot 38 is to be immobilized within opening 37 or within openings 37', 37'', or 37''', it will be free to rotate about axes 5 or 5' within openings 62 and 63.

In this fashion, support 41 can occupy not only the positions illustrated in FIGS. 2 and 2*a*, but also the positions illustrated in FIGS. 1 and 3*a*, in which the support rests, via surfaces 56 and 57, against strips 12 and 13 of the upper ski surface 11 along the rear of mounting element 18 (and wherein a boot 4 which can be attached by retention apparatus 44 at support zone 43). In this manner, support 4 rests on upper ski surface 11 by placing the longitudinal groove of sole 64 on the rib surface, and can be moved into a position such as that illustrated in FIG. 4, in which by lifting the boot heel and pivoting support 41 about axis 5 or 5' with respect to mounting element 8 in a direction 65 which extends forwardly and longitudinally above axis 5 and 5'. In this position, the posterior or rear zones of surfaces 56 and 57 which initially rest on strips 12 and 13 of ski surface 11 will be offset upwardly with respect to these strips.

Support 41 naturally occupies the position illustrated in FIGS. 1, 2, 2*a*, 3 and 3*a* when the support is not biased in direction 65 by the presence of a boot 4. Support 41 is placed into this position by the use of elastic return or biasing means for support 41, which bias the support in a direction 66 which is opposite to direction 65, and which elastically press support 54, via its surfaces 56 and 57, against strips 12 and 13 of upper ski surface 11 at the rear of mounting element 18.

In accordance with the present invention, the elastic biasing means of support 41 comprise two spaced longitudinal tongues 67 and 68, each of which is elastic and flexible. The tongues are respectively positioned along opposite sides of ski rib 14, and more precisely on respective sides of zone 33 of mounting element 18. Each of these resilient members has a respective rear end 69, 70 which is attached to zone 42 of support 41, directly forwardly of journal axis 5 or 5' of mounting element 18. Further, the respective front ends 71 and 72 of the tongues are journalled or pivoted on intermediate mounting element 18 about a second axis 77 which is parallel to axis 5 or 5' and which is attached to the intermediate mounting element above surface 26 of covering zone 31 and surface 27 of covering zone 32, without the possibility of any other displacement of front ends 71 and 72 of the tongues with respect to mounting elements 18 and ski 1.

In the example which is illustrated in FIGS. 1–4, axis 77 is positioned above upper surface 15 of rib 14, in a zone of mounting element 18 which is closer to front transverse surface 34 than to rear transverse surface 35.

In this zone, upper surface 30 of element 18 carries a projection or protuberance 78 in a stationary fashion. This protuberance extends upwardly and is similar to the previously described projection 36, particularly with respect to its location vis-a-vis plane 6 and the coplanar local projections on surfaces 28 and 29. Projection 78 is bored along both of its sides along the axis 77, i.e., from surface 28 toward surface 29 perpendicularly with respect to axis 6. The bore in projection 78 (which is not shown in the drawings), comprises a cylinder of revolution about axis 77 having a diameter selected so that the bore will not be secant to surface 21 of intermediate element 18. To this end, the diameter of the cylinder of revolution is less than twice the distance which separates axis 77 from surface 21 in a direction which is perpendicular to such surface.

In the embodiment of the invention which is illustrated in FIGS. 2*a* and 3*a*, however, the journal axes of front ends 71 and 72 of respective tongues 67 and 68 are transverse with respect to the longitudinal extent of the ski, and cut or intersect ski 1 along the level of rib 14 in a fashion similar to that of axis 5'. The second transverse axis is represented by axis 77' in FIG. 2*a*. It should be noted that in other embodiments of the present invention which are not illustrated, it is possible to position the journal axis for support 41 on mounting element 18 as indicated at 5, and to position the journal axis of the front ends of the tongues on elements 18 as indicated at 77'; or, it is possible to select an axis such as 5' in combination with an axis of the type indicated by axis 77. In other words, all possibilities are contemplated as being within the scope of the present invention. In the embodiment illustrated in FIGS. *2a* and *3a*, surface 30 can be formed without a localized projection 78, and the bore of the projection can instead be replaced by bores which are cylinders of revolution which surround axis 77' and which are provided, respectively, in the intermediate mounting element 18 between surfaces 28 and 20, between surfaces 22 and 29, and in rib 14 between the surfaces of sides 16 and 17; these will be provided in a fashion similar to the manner in which bores 37', 37'', and 37''', respectively, having identical diameters, have been provided. The bores of axis 77' can thus be integrally positioned between surface 21 and surfaces 26 and 27. To this end, the diameters are predetermined as previously noted with respect to bores 37', 37'', and 37'''.

Dependent upon the embodiment, either the single bore of axis 77 in projection 78 of the upper surface 30 of intermediate mounting element 18, or the assembly formed by the bores of axis 77' which are respectively provided in intermediate mounting element 18 and in rib 15, receive a coaxially positioned pivot 79 which is generally configured as a cylinder of revolution about either of axes 77 or 77'; this cylinder of revolution will have a diameter which is substantially equal to the diameter of the bore of either axis 77 or axis 77'. It should be understood that the axis can be immobilized, or that pivot 79 could freely and rotatably move about either of the bores of axes 77 or 77'.

Pivot 79 will have a length, as viewed along axis 77 or 77', which is greater than the distance which separates opposed side surfaces 28 and 29 of intermediate mounting element 18, in such a manner that a projecting portion of the pivot will be formed with respect to both of these surfaces, above surfaces 26 and 27, the projections being symmetrically positioned with respect to plane 6. Preferably, to this end, pivot 79 is defined by planar end surfaces, e.g., surfaces 80, which are perpendicular to either of axes 77 or 77'; and these end surfaces are mutually spaced from each other along axis 77 or 77' (dependent upon the specific embodiment) by a distance which is equal to the distance which separates surfaces 24 and 25. End surfaces such as surfaces 80 are accordingly coplanar with surfaces 24 and 25 when pivot 79 is positioned symmetrically about plane 6.

In a complementary fashion, each of the flexible tongue front ends 71 and 72 includes, along a single axis which is substantially perpendicular to plane 6, a bore, e.g., bore 81, which comprises a cylinder of revolution about the axis having a diameter which is substantially equal to the diameter of pivot 79. The pivot can be positioned coaxially within a bore such as bore 81 in order to ensure rotatable guidance of respective front ends 71 and 72 of tongues 67 and 68 around either axis 77 or axis 77', all with respect to intermediate mounting element 18. The pivot can either be freely rotatable about its respective axis 77 or 77' or it can be immobilized in a stationary position so that it will not rotate within bores 81 of tongues 67 and 68.

In accordance with one embodiment which is not illustrated in the drawings, tongues 67 and 68 can be formed as separate elastically flexible elements attached to rigid support 41, in which zones 42 and 43 are effectively merged together. However, as illustrated in the drawings, it is preferable to form tongues 67 and 68 in an integral fashion from a single piece of material together with support 41, including zones 42 and 43 therewith. In this embodiment, the unitary piece, which is made from material which is either elastically flexible or rigid, dependent upon whether it is formed as a plate or a relatively thin bar, or as a compact block, includes materials such as, e.g., ARNYTEL or HYTREL, which are polyamides. Of course, other materials having the desired properties which are known to those of skill in the art could be selected without going beyond the scope of the present invention.

Accordingly, in the embodiment which has been illustrated, tongues 67 and 68 are formed from a unitary piece of material together with support 41, and zones 42 and 43 will merge together in such an instance. The tongues join each other along respective coplanar extensions of surfaces 48 and 49, respectively; and the tongues are longitudinally spaced from each other by respective coplanar extensions of surfaces 60 and 61, respectively.

First and second tongues 67 and 68 are symmetrically positioned with respect to plane 6 and include upper edge surfaces 73 and 74, which surfaces are defined by generatrices which are perpendicular to plane 6. Towards their respective bottoms, edge surfaces 73 and 74 define a concave shape which follows a path, as viewed from the rear towards the front of the ski, from respective zones which rise towards the front from surface 56 of wing 45 and from surface 57 of wing 46, then include frontwardly descending zones, until they reach the respective front ends 71 and 72, where edge surfaces 73 and 74 have convex shapes in the form of a semi-cylindrical revolutionary shapes as taken about either of axes 77 or 77'. As a result, each of the tongues is adapted to first flex upwardly an towards the front of the ski, and then rearwardly and downwardly, and each has a radius less than the distance separating axis 77 from surfaces 26 and 27 of intermediate mounting element 18. The radius is greater than the radius of bores such as bores 81.

Along the top surface of the flexible members, as viewed from the semi-cylindrical zone referred to, each edge surface 73 and 74 has a convex shape, which surfaces are substantially parallel at least with respect to the concave zone as previously defined, and at least with respect to the respective rear ends 69 and 70. At these points, edge surfaces 73 or 74 are connected to the lower portions of surfaces 51 of support zone 42 by respective cutout or recessed areas 75, 76, which cutouts are oriented in a perpendicular fashion with respect to plane 6 and which extends, respectively, from surface 67 to surface 48, or from surface 49 towards surface 68 in order to define, along the respective rear ends 69, 70 of tongues 67, 68, localized thinned areas (as viewed with respect to the height of the tongue). These thinned areas define a preferred elastic flexion zone for each tongue as viewed along the direction of the height of the tongue. The thinned areas serve to connect the tongues to support 41, which is itself a rigid member.

In the position of support 41 which is illustrated in either FIGS. 2 or *2a*, tongues 67 and 68 are precompressed so that they will firmly bias or apply support 51, via respective support zones located rearwardly of surfaces 56 and 57 located to the rear of element 18, against strips 12 and 13 of upper ski surface 11. In this manner, the tongues will provide elastic resistance against movement of support 41 in forward direction 65 once the rear support zones no longer contact strips 12 and 13, respectively. It is possible to similarly provide that, in the absence of any biasing of support 41 by a boot, tongues 67 and 68 will position the support in a position (not whose in the drawings) in which the rear support zones are upwardly offset with respect to upper surface 12 and 13 so that during use, no resistance will be provided when boot 4 and support 41 occupy the positions illustrated in either FIGS. 2 or 2*a*. This resistance, along the direction represented by arrow 66, will only arise after boot 4 and support 41 have traversed a predetermined angle along direction 65 with respect to intermediate mounting element 18 and ski 1.

It is possible to alter the elastic return effect which is imparted to support 41 by tongues 67 and 68 by changing the position of axis 77 (or 77') with respect to axis 5 (or 5') on mounting element 18, on one hand, and with respect to tongues 67 and 68, on the other hand.

Preferably, a plurality of bores can be provided in each of front ends 71 and 72 of tongues 67 and 68; these bores are cylinders of revolution about axes, e.g., axis 82, which are perpendicular to plane 6. The bores are mutually offset from each other and have diameters similar to the diameter of bore 81. The bores are substantially coaxial, e.g., bore 83 of front tongue end 71 and bore 84 of front tongue end 72 are coaxial, so that pivot 79 can be freely engaged within one of the pairs of bores which are coaxial with each other, as viewed from one tongue to the other. This makes it possible to alter the elastic bias applied by the tongues to support 41 along direction 66. Further, as illustrated in FIGS. 5–7, the intermediate mounting elements 18 can be constructed so as to permit free selection among a plurality of positions for either axis 77 or axis 77' with respect to axis 5 or 5'.

Specifically, FIGS. 5–7 illustrate respective intermediate mounting elements 18*a*, 18*b*, and 18*c* which are quite similar to the intermediate mounting element 18 described above. In FIGS. 5–7, elements 21, 23, 25, 27, 29, 30, 32, 33, 34, 35, 36, 37 and 78 (and any appropriate reference letters a, b, or c) of mounting element 18 are identical to similarly referenced elements which were previously described, except with respect to the shape and structure of projections 78*a*, 78*b* and 78*c*, corresponding to projection 78, which define the position of axis 77 which journals the tongues with respect to the support journal axis 5. Axis 5 and direction 7 are also similar to those elements previously described.

In FIG. 5, localized projection 78*a*, which is positioned on the upper surface 30*a* of intermediate mounting element 18*a*, between projection 36*a* and front end surface 34*a* of element 18*a*, corresponds to projection 78. Projection 78*a* is spaced on either side of the longitudinal median plane of the ski by a surface of element 18*a* which corresponds to surface 28 of element 18, and by surface 29*a* of mounting element 18*a*. On the other hand, the projection will have longitudinal dimensions which are greater than those of projection 78, and projection 78*a* is interiorly bored from one side to the other, along respective axes 85*a* which are parallel to axis 5, and which are mutually offset, either longitudinally or along a vertical dimension of the mounting elements. Identical bores 86*a* are provided, each of which comprises a cylinder of revolution about a respective axis 85*a* and which has a diameter which is substantially identical to the diameter of pivot 38 so that each bore 86*a*, as described, can receive a pivot 79 coaxially therein, such that axis 77 will coincide with axis 85*a*. Pivot 79 can be immobilized with respect to element 18*a* against displacement in any radial direction with respect to such coincident axes, dependent upon whether, respectively, pivot 79 is to be immobilized against rotation within a bore 81, 83, or 84 of a tongue 67 or 68; or, to the contrary, so that the pivot can be freely rotatable within the bores, pivot 79 can be adapted to be mounted with a bore 86*a* such that it can be freely rotated around axis 85*a* of the bore with respect to mounting element 18*a* or so that it can be immobilized against such rotation.

Naturally, the respective positions of the various axes 85*a* with respect to axis 5 are selected by those of skill in the art in a manner such as to engage or position pivot 79 within any of bores 86*a* to produce a predetermined effect on the elastic biasing of support 41 along direction 66 by tongues 67 and 68. The effect will evolve or change as a function of the angular position of support 41 with respect to intermediate mounting element 18*a*. As illustrated in FIG. 6, projection 78*b* has a shape which is substantially identical to that of projection 78*a* and is bored along both of its opposed sides, i.e., one side surface of mounting element 18*b* is bored from the surface of element 18*b* which corresponds to surface 28 of element 18 to surface 29*b* of element 18*b*, by a longitudinal slot 86*b* which is defined by generatrices which are parallel to axis 5 and which include a median plane 85*b* which is either parallel to axis 5 or which includes such an axis. Slot 86*b* has a dimension, in a direction perpendicular to plane 85*b*, which is substantially equal to the diameter of pivot 79 so that it can receive the pivot in such a manner that the pivot can slide relatively thereto in a longitudinal fashion, i.e., axis 77 can be displaced along plane 85*b*, while maintaining the axis in a direction parallel to axis 5, as a result of the mutual symmetry of tongues 67 and 68 with respect to the longitudinal median plane 6 of the ski. For this purpose, slot 86*b* can be provided with dimensions greater than the diameter of pivot 79 when measured longitudinally, e.g., along plane 85*b*. Any structure which is known to those of skill in the art and which is capable of immobilizing pivot 79 against longitudinal sliding within slot 86*b* could be used, irrespective of the longitudinal position that the pivot occupies within the slot. As one example, the pivot could be engaged within a slide, could be symmetrically positioned with respect to plane 6, and could have a longitudinal position, with respect to mounting element 18*b*, which would be adjustable by a micrometric screw or by other structure which would clearly be within the skill of one of ordinary skill in the art. It should be clearly understood that such structure can achieve, when the position of axis 77 is adjusted with respect to the position of axis 5, total immobilization of axis 77 with respect to mounting element 18*b*.

In FIG. 7, the single localized projection 78 is replaced by a plurality of projections 78*c*. Projections 78*c* are positioned along upper surface 30*c* of localize projection 36*c* and front end surface 34*c* of element 18*c*. Each projection 78*c* extends from the upper side surface of mounting element 18*c*, which surface corresponds to surface 18 of element 18, and to surface 29*c* of element 18*c*. Each projection 18*c*, viewed along the longitudinal median plane 6 of the ski, as well as over a cross-sectional plane which is parallel to plane 6, defines an omega-shaped cross-section which opens rearwardly and upwardly. The cross-section is defined by a respective cut out 86c which comprises a cylinder of revolution about a respective axis 85c which is parallel to axis 5 and which occupies a predetermined position with respect to axis 5, the cylinders each having a diameter which substantially corresponds to the diameter of pivot 79. Each cut out 86c is open towards its rear and top to permit the introduction and selectively removable retention, e.g., by ratcheting, of pivot 79 in any one of cut outs 86c, i.e., so that journal axis 77 of tongues 67 and 68 will be coincident with one of the axes 85c. For this purpose, element 18c is provided with, particularly at the level of localized projections 78c, an appropriate elasticity.

Naturally, although FIGS. 5–7 represent an embodiment in which the axes 5 and 77 are positioned above the upper surface 15 of rib 14 of upper ski surface 11, the structure which has been described for adjusting the position of axis 77 can identically be used in the case of an axis 5' which will cut (i.e., extend through) the ski at the level of the rib, as schematically illustrated by the crossed, dashed lines in FIGS. 5–7. Similarly, it is possible to adopt a structure for adjusting the position of the journalled axes of tongues 67 and 68 in a fashion similar to the way that the axes were adjusted when described with respect to FIGS. 5–7, in which axis 77' intersects the ski at the level of the upper rib. Accordingly, referring to the embodiment of FIG. 5, projection 78a is omitted and bores 86 of respective axes 85a are replaced by analogous bores which are provided along axes 85'a, which bores are parallel to axis 5 and cut rib 1. Bores are thus provided coaxially in intermediate mounting element 18a and in ski rib 14.

In the embodiment illustrated in FIG. 6, projection 78b is eliminated, and a longitudinal slot which is analogous to slot 86b is provided, both in intermediate mounting element 18b and in ski rib 14, along a median plane 85'b which is perpendicular to plane 6 and which intersects rib 14 of the ski.

In the embodiment of FIG. 7, projections 78c are eliminated, and localized cutouts or recesses 86b are surface 15 and rib 14 of upper ski surface 11, along respective axes 85c which intersect rib 14.

Of course, other structure for adjusting the relative positions of the journal axes of the tongues and of the support on the intermediate mounting element can be used without going beyond the scope of the present invention. Similarly, by providing appropriate cutouts, e.g., cutouts 87 in longitudinal strips 12 and 13 of upper ski surface 11, as schematically shown in FIG. 2a, by providing an appropriate extension of element 18 downwardly towards the interior of the cutout, and by providing an appropriate extension of element 18 which extends downwardly towards the interior of the cutout, as well as an appropriate extension of wings 45 and 46 of support 41, it is possible to journal the support on the ski about an axis 5'' which intersects/cuts the ski beneath the rib, irrespective of the level of the journal axes of the respective front ends of tongues 67 and 68 on intermediate mounting element 18. Similarly, by providing cutouts, e.g., cutout 87, towards the bottom of element 18, it is possible to journal the front ends of tongues 67 and 68 on intermediate mounting elements 18 about an axis 77'' which intersects the ski beneath the ski rib, this time irrespective of the level of the journal axis of the support with respect to the intermediate mounting element.

It should be further noted that the use of an intermediate mounting element, e.g., element 18, 18a, 18b or 18c to provide a pivotable mounting for either the support or the front ends of the elastically flexible tongues to the ski, is not necessary when the axis of the pivotable member intersects the ski; this is true whether the axis is at the level of the rib of the upper surface of the ski, as illustrated at 5' and 77', respectively, or when it is located below the rib, as illustrated at 5'' and 77'', respectively, as shown in FIG. 2a. In other words, where the axis or axes cut the ribs or the ski sides when using the mounting member, such a member could be easily eliminated.

Specifically, FIGS. 8–14 illustrate an apparatus in accordance with the invention which is quite similar to that which has been described with respect to FIGS. 1–7 and FIGS. 2a and 3a, respectively, except that the support which carries, towards its rear, apparatus for retaining the front end of a boot, and the front ends of the elastically flexible tongues for biasing the pivotable support, are directly connected to the ski around respective axes which intersect or cut the ski at the level of the upper surface of the rib.

As a result, FIGS. 8–14 include elements 101–104, 105', 106–117, 137''', 138–176, 177', 177'', 179–184, 185'a, 185'b, 195'c, and 187 which correspond to elements 1–4, 5', 6–17, 37''', 38–76, 77', 77'', 79–84, 85'a, 85'b, 85'c, and 87, respectively, which have been illustrated and previously described in detail with respect to FIGS. 1–8 and FIGS. 2a and 3a. The only differences between these elements (because elements labelled with reference numbers between 0 and 100 correspond to similar elements between 100 and 200, respectively) are described hereinafter. In fact, only elements 5, 18–36, 37, 37', and 37'' are absent from the embodiment illustrated in FIGS. 8–14, as they were shown in the embodiment of FIG. 1–7.

As seen more particularly in FIG. 10, the surfaces of sides 116 and 117 of longitudinal rib 114 of ski 101 are hollowed out in the central zone of the rib, such that they will thereby receive binding apparatus 102. Respective openings 191 and 192, which are defined along the bottom by respective extensions of strips 112 and 113 in the direction of the median longitudinal plane 106 of the ski, and, on the other hand, towards plane 106 by respective planar surfaces 189 and 190 which are mutually parallel and symmetrical with each other with respect to plane 106. Surfaces 189 and 190 are angled inwardly towards the central rib, and these surfaces 189 and 190 serve to connect respective extensions of strips 112 and 113 of ski surface 111 to upper rib surface 115, and to connect the surface 115 to generally rectilinear extensions of respective surfaces 116 and 117 of rib 114 having surface 115. These surfaces can, e.g., as shown in FIGS. 12–14, include the pivot receiving slot, apertures, or ratchet structure. As a result, pivots 138 and 179 have, along axes 105' and 177', respectively, as was the case with pivots 38 and 79, a length which is equal to the spacing between the surfaces of sides 109 and 110 of ski 101; the pivots form projections along both sides of rib 114, with respect to surfaces 189 and 190 of respective openings 191 and 192. The projections on pivot 138 engage bores 139 and 140 of support wings 146 and 147 and respective bores, e.g., bores 181, of front ends 171 and 172 of tongues 167 and 168. In order to ensure immobilization of support 141 against translation along axis 105' with respect to the ski 101, surfaces 148 and 149 of support 141 are turned inwardly towards median longitudinal plane 106 of the ski, are planar and parallel, and are both symmetrical with respect to plane 106 as was the case with respect to surfaces 48 and 49. The relative spacing between these surfaces is substantially identical to the relative spacing of surfaces 189 and 190 perpendicular to plane 106, such that surface 148 will be flattened against surface 189 and so that surface 149 will rest flat against surface 190, with the possibility of relative sliding between the surfaces.

Further, in the absence of an intermediate mounting element which corresponds to element 18 of FIGS. 1–7, surface 150 of support 141 has a planar shape which is adapted to mate with rib surface 115 of ski 101, in the position of support 141 which is illustrated in FIGS. 9 and 10, in order to provide a continuous clearance 152 having a specified thickness between the inner/lower support surface and the upper ski surface. Support 141 remains flat, via the support zones located rearwardly of lower surfaces 156 and 157 of respective wings 145 and 146, against strip 112 and strip 113 of upper ski surface 111, rearwardly of axis 105'. For this purpose, as is illustrated in FIG. 9 with respect to opening 192, the two openings 191 and 192 extend towards the rear beyond respective connection surfaces 156 and 157 to support surface 153, where an opening 192 and its associated surface 190 are connected to the surface of a corresponding side, e.g., rib side 117, by transverse planar surface 193 which faces forwardly. Similarly, in the absence of an element which corresponds to element 18, clearances 158 and 159 are used to facilitate pivoting of support 141 in a direction 165 which corresponds to raising the support zones located to the rear of axis 105'; as illustrated in FIG. 11, the raised zones are respectively provided between a Zone located forwardly of surface 156 and strip 112, and a zone located forwardly of surface 157 and strip 113, respectively.

Forwardly, surfaces 189 and 190 have openings 191 and 192 which extend beyond the most forward possible extreme position of front ends 171 and 172 of elastically flexible tongues 167 and 168, as illustrated with respect to opening 192, by providing a transverse front end surface 194 which is planar and which connects surface 190 to a surface of slide 117 of ski rib 114.

In order to provide for pivotable mounting of front ends 171 and 172 of tongues 167 and 168, rib 114 of upper ski surface 111 can be provided with a single receiving bore which is coaxial with pivot 179, which bore will be oriented and dimensioned as above with respect to the bore of the localized projection 78. This bore will open into surfaces 189 and 190 of openings 191 and 192, respectively, and the position of axis 177' with respect to axis 105' will not be movable.

However, in addition to the possibility of adjusting the position of axis 177' with respect to tongues 167 and 168 via engagement of pairs of pivots 179 into freely selected pairs of coaxial bores, e.g.. bores 183 and 184, whose positions are carefully located over the tongues, as was the case with mounting pivot 79 and tongues 67 and 68, it is also possible (and preferable) to adjust the position of axis 177' with respect to axis 105' along the longitudinal direction and/or along the direction of the height of the tongues.

Structure for adjusting the position of the axis with respect to the tongues is illustrated in FIGS. 12–14. FIG. 12 illustrates a plurality of bores **186'*a* in respective surfaces 189 and 190 of openings 191 and 192; these bores are quite comparable to bores 86*a* which are described with respect to FIG. 5, and are positioned along respective axes 185'*a* positioned as with respect to axes 85*a*. FIG. 13 illustrates the use of a longitudinal slot 186'*b* in rib 114 which is in all ways analogous to longitudinal slot 86*b*, taken along a median plane 185'*b* position as was the case with plane 85'*b*. FIG. 14 illustrates the use of recesses or hollowed cutouts 186'*c* in the upper rib surface 115, which are analogous to cutouts 86*c*, and which include respective axes 185'*c* positioned as was the case with axes 85'*c*. Bores 186'*a*, slots 186'*b* and cutouts 186'*c* open under surfaces 189 and 190 of openings 191 and 192. Pivot 179 can be coaxially engaged, as desired, in any one of the openings 186'*a* or can be coaxially ratcheted within one of cutouts 186'*c*. The pivot can be freely and slidably received within slot 186'*b* and can be immobilized in any longitudinal position along the length of the slot, as described with respect to FIG. 6** previously.

Of course, it is possible to directly and pivotably mount support 141 and respective front ends 171 and 172 of elastically flexible tongues 167 and 168 about respective axes 105" and 177" which intersect the ski at a level below the level of rib 114; this can be achieved by providing cutouts, e.g., cutouts or recesses 187 in strips 112 and 113 which border longitudinal rib 114 of upper ski surface 111. Such mounting, which is within the normal scope to those of ordinary skill in the art, is schematically illustrated in dotted lines (for recess 187) in FIG. 9.

Further, even though the embodiments of the invention which have been illustrated and described correspond to circumstances in which the pivotable mountings of the support and of the front ends of the the tongues occur in the same fashion, i.e., either by using a mounting element, or directly onto the ski, it would not be beyond the scope of the present invention to provide a pivotable mounting which was fixedly mounted to the ski in a fashion which would be comparable to either the front zone of the intermediate mounting element 18, **18*a*, 18*b* or 18*c***, or to a rear zone of the intermediate mounting element, and/or by directly gripping the other pivot with the ski. Modifications of this spirit are within the scope and the normal capacity of those of ordinary skill in the art.

Finally, although the present invention has been described with respect to particular means, materials and embodiments throughout, it should be clearly understood that the invention is not limited to the particular embodiments disclosed, and extends to all equivalents which are within the scope of the present claims.

What is claim is:

1. A binding apparatus which is adapted to attach the front end of a boot to a ski, said ski having an upstanding central rib and an upper surface, said apparatus comprising:

(a) a support which is adapted to be pivotably mounted to said ski about a first axis which is transverse to the longitudinal extent of said ski, said support having a front end and a rear end, wherein the rear end of said support comprises means for retaining said front boot end on said ski when said apparatus is attached to a ski; and (b) means for elastically biasing said support to rotate about said first axis in a predetermined direction rearwardly and towards the surface of said ski, said elastic biasing means comprising first and second longitudinal tongues adapted to be positioned on either side of said rib of a ski to which said binding is adapted to be attached, said longitudinal tongues being elastically flexible, each tongue having a rear end attached to said support and a front end, the front end of each of said tongues being adapted to be pivotably mounted about a second axis transverse to the longitudinal extent of said ski, wherein said first and second transverse axes are mutually parallel and are spaced from each other, and further comprising means for adjusting the relative positions of said first and second axes with respect to each other.

2. Apparatus in accordance with claim 1, wherein said binding apparatus is attached to a ski, said ski having two longitudinal strips located on either side of said longitudinal rib, said rib and said strips having upper surfaces which together form an upper surface of said ski.

3. Apparatus in accordance with claim 1, wherein said adjusting means comprise means for adjusting the position of said second transverse axis with respect to the position of said first transverse axis.

4. Apparatus in accordance with claim 1, wherein said adjusting means comprise means for adjusting the position of said second transverse axis with respect to the position of said tongues.

5. Apparatus in accordance with claim 4, wherein said tongues and said support are formed integrally from a unitary block of material.

6. Apparatus in accordance with claim 5, wherein each of said tongues has a thin portion located between a front end and a rear end of said tongue, each said thinned portion comprising an elastic flexion zone for each said tongue.

7. Apparatus in accordance with claim 1, wherein said first axis is positioned above said longitudinal rib of said ski when said boot is attached to said ski.

8. Apparatus in accordance with claim 1, wherein said apparatus further comprises at least a first intermediate mounting member which is adapted to be attached to the upper surface of said ski, said support being pivotably mounted to said intermediate mounting member about said first axis.

9. Apparatus in accordance with claim 8, said apparatus comprising a second intermediate mounting member adapted to be attached to the upper surface of said ski, said front ends of said tongues being adapted to be pivotably mounted about said second axis to said second intermediate mounting member.

10. Apparatus in accordance with claim 9, wherein said first and said second intermediate mounting members comprise a single intermediate mounting assembly which is adapted to be attached to said upper ski surface.

11. Apparatus in accordance with claim 10, said apparatus further comprising a rigid pivot connecting front ends of said tongues along said second axis, said second intermediate mounting member comprising means for receiving said pivot.

12. Apparatus in accordance with claim 1, wherein said second axis is located above said longitudinal rib when said binding is attached to said ski.

13. Apparatus in accordance with either of claims 11, said apparatus comprising means for receiving said pivot in a stationary fashion to prevent radial movement of said pivot with respect to said second axis.

14. A binding which is adapted to be positioned on a ski having a longitudinally extending upper surface, said binding comprising:

(a) a support member which includes means for retaining the front end of a ski boot on said ski when said binding is attached to said ski and said ski boot is positioned on said ski;

(b) two substantially flexible, elastic arms each arm having a front end and a rear end and being attached at said rear end to said support member, said front arm ends including means for attaching said arms to said ski when said binding is positioned on said ski;

(c) an intermediate mounting element adapted to be positioned between said arms and the upper surface of said ski, each of said arms including an aperture which is adapted to be aligned with a pivot receiving aperture on said intermediate mounting element; and (d) two space apertures on said front ends of each of said arms, said apertures comprising means for adjustably positioning said front end of each said arm with respect to said ski.

15. Apparatus in accordance with claim 14, wherein said mounting member includes a generally cylindrical bore which is adapted to receive at least one pivot pin around which said front ends of said arms are adapted to be pivoted.

16. Apparatus in accordance with claim 15, further comprising a pivot pin adapted to be inserted into said bore in said mounting element for pivoting said front ends of said arms about a second axis parallel to a first axis about which said support is adapted to be pivoted.

17. Apparatus in accordance with either of claim 14, wherein said front ends of said arms are adapted to be pivoted to said upper ski surface at a point which extends above the upper surface of said ski when said binding is attached to said ski.

18. Apparatus in accordance with claim 14, further comprising means for pivotably attaching said support to said ski.

19. A binding apparatus which is adapted to attach the front end of a boot to a ski, said ski having an upstanding central rib and an upper surface, said apparatus comprising:

(a) a support which is adapted to be pivotably mounted to said ski about a first axis which is transverse to the longitudinal extent of said ski, said support having a front end and a rear end, wherein the rear end of said support comprises means for retaining said front boot end on said ski when said apparatus is attached to a ski;

(b) means for elastically biasing said support to rotate about said first axis in a predetermined direction rearwardly and towards the surface of said ski, said elastic biasing means comprising first and second longitudinal tongues adapted to be positioned on either side of said rib of a ski to which said bonding is adapted to be attached, said longitudinal tongues being elastically flexible, each tongue having a rear end attached to said support and a front end, the front end of each of said tongues being adapted to be pivotably mounted about a second axis transverse to the longitudinal extent of said ski, wherein said first and second transverse axes are mutually parallel and are spaced from each other;

(c) a first intermediate mounting member and a second intermediate mounting member forming a single intermediate mounting assembly which is adapted to be attached to said upper ski surface, said support being pivotably mounted to said first intermediate mounting member about said first axis, said front ends of said tongues being adapted to be pivotably mounted about said second axis to said second intermediate mounting member; and (d) a rigid pivot connecting front ends of said tongues along said second axis, said second intermediate mounting member comprising means for receiving said pivot, said means for receiving said pivot comprising a plurality of bores located along respective axes generally transverse to the longitudinal extent of the ski, which are parallel to said first axis, and which are mutually offset and occupy a plurality of predetermined positions with respect to said first axis, each of said bores being adapted to immobilize said pivot against relative movement in a radial direction.

20. A binding apparatus which is adapted to attach the front end of a boot to a ski, said ski having an upstanding central rib and an upper surface, said apparatus comprising:

(a) a support which is adapted to be pivotably mounted to said ski about a first axis which is transverse to the longitudinal extent of said ski, said support having a front end and a rear end, wherein the rear end of said support comprises means for retaining said front boot end on said ski when said apparatus is attached to a ski;

(b) means for elastically biasing said support to rotate about said first axis in a predetermined direction rearwardly and towards the surface of said ski, said elastic biasing means comprising first and second longitudinal tongues adapted to be positioned on either side of said rib of a ski to which said binding is adapted to be attached, said longitudinal tongues being elastically flexible, each tongue having a rear end attached to said support and a front end, the front end of each of said tongues being adapted to be pivotably mounted by a pivot about a second axis transverse to the longitudinal extent of said ski, wherein said first and second transverse axes are mutually parallel and are spaced from each other, and wherein the front end of each tongue comprises a plurality of bores provided along said second axis which are substantially coaxial with corresponding bores on the other tongue and which are adapted to receive said pivot and to immobilize said pivot against motion.

21. A binding which is adapted to be positioned on a ski having a longitudinally extending upper surface, said binding comprising:

(a) a support member being pivotably mounted on said ski which includes means for retaining the front end of a ski boot on said ski when said binding is attached to said ski and said boot is positioned on said ski, and (b) two substantially flexible, elastic arms, each arm having a front end and a rear end and being attached at said rear end to said support member, said front arm ends including means for pivotably attaching said arms to said ski when said binding is positioned on said ski, wherein said binding includes means for enabling said front ends of said arms to be selectively pivotably attached to said ski at a plurality of positions along the longitudinal extent of said ski.

22. Apparatus in accordance with claim 21, wherein said front arm ends are selectively positioned on an intermediate mounting member.

23. Apparatus in accordance with claim 22, further comprising a plurality of spaced apertures on said intermediate mounting member, each of said apertures comprising means for adjustably receiving a pivot pin to establish said second axis.

* * * * *

UNITED STATES PATENT AND TRADEMARK OFFICE

CERTIFICATE OF CORRECTION

PATENT NO. : 4,887,832

DATED : December 19, 1989

INVENTOR(S) : Marc PROVENCE

It is certified that error appears in the above-identified patent and that said Letters Patent is hereby corrected as shown below:

Column 6, line 16, change "FIG" to ——FIGS——;
Column 7, line 49, change "ay" to ——any——;
Column 8, line 20, delete ".." before "formed";
Column 9, line 45, change "1" to ——16——;
Column 9, line 49, insert ——1—— after "ski";
Column 10, line 25, change "With" to ——with——;
Column 11, line 37, change "axis" to ——axes—— before "by";
Column 11, lines 42/43, change "separate" to ——separates——;
Column 11, line 68, change "4,382,611" to ——4,382,611),——;
Column 14, line 2, change "4" to ——41——;
Column 14, line 7, change "8" to ——18——;
Column 14, line 39, change "elements" to ——element——;
Column 14, line 52, change "axis" to ——plane——;
Column 15, line 3, change "elements" to ——element——;
Column 15, line 28, change "15" to ——14——;
Column 16, line 35, delete "a";
Column 16, line 38, change "an" to ——and——;
Column 16, line 51, change "surfaces" to ——surface——;
Column 16, line 65, change "51" to ——41——;
Column 17, line 7, change "whose" to ——shown——;

UNITED STATES PATENT AND TRADEMARK OFFICE

CERTIFICATE OF CORRECTION

PATENT NO. : 4,887,832

DATED : December 19, 1989

INVENTOR(S) : Marc PROVENCE

It is certified that error appears in the above-identified patent and that said Letters Patent is hereby corrected as shown below:

Column 17, line 8, change "upper surface" to ——strips——;

Column 18, line 59, change "localize" to ——localized——;

Column 18, line 63, change "18" to ——28—— after "surface";

Column 19, line 28, change "86" to ——86a——;

Column 19, line 30, change "1" to ——14——;

Column 19, line 40, change "86b" to ——86c——;

Column 19, between lines 40 and 41, insert ——provided in upper surface 30c of element 18c and in an upper——;

Column 20, line 24, change "195'c" to ——185'c——;

Column 20, line 61, change "146 and 147" to ——145 and 146——;

UNITED STATES PATENT AND TRADEMARK OFFICE

CERTIFICATE OF CORRECTION

PATENT NO. : 4,887,832

DATED : December 19, 1989

INVENTOR(S) : Marc Provence

It is certified that error appears in the above-identified patent and that said Letters Patent is hereby corrected as shown below:

Column 21, line 32, change "Zone" to —zone—;
Column 22, line 3, change "85'b" to —85b—;
Column 22, line 7, change "85'c" to —85c—;
Column 22, line 30, change "the the" to —the—;
Column 23, line 60, change "either of claims" to —claim—;
Column 24, line 15, change "space" to —spaced—;
Column 24, line 29, delete "either of"; and
Column 24, line 53, change "bonding" to —binding—.

Signed and Sealed this

Thirteenth Day of August, 1991

*Attest:*

HARRY F. MANBECK, JR.

*Attesting Officer*

*Commissioner of Patents and Trademarks*